US005354131A

United States Patent [19]

Mogil

[11] Patent Number: 5,354,131

[45] Date of Patent: Oct. 11, 1994

[54] BAG HANDLE WITH SUPPORT LOOP

[75] Inventor: Melvin S. Mogil, Toronto, Canada

[73] Assignee: California Innovations Inc., Willowdale, Canada

[21] Appl. No.: 34,385

[22] Filed: Mar. 18, 1993

[51] Int. Cl.[5] ..... A45C 3/00; A45C 11/20; A45C 13/26

[52] U.S. Cl. ..... 383/24; 383/97; 383/110; 190/102; 190/108; 150/109; 150/111

[58] Field of Search ..... 323/11, 24, 61, 26, 323/4, 97; 190/102, 108; 150/109, 111

[56] References Cited

U.S. PATENT DOCUMENTS

| | | | |
|---|---|---|---|
| 1,743,496 | 1/1930 | Parrella | 150/190 X |
| 2,105,319 | 1/1938 | Hedden et al. | 383/4 X |
| 2,289,254 | 7/1942 | Eagles | 383/86 X |
| 2,319,729 | 5/1943 | Ford | 190/102 |
| 2,669,272 | 2/1954 | Permann | 383/86 X |
| 2,707,035 | 4/1955 | Lashley | 190/108 X |
| 2,813,602 | 11/1957 | Macarhor, Jr. | 190/108 X |
| 2,858,957 | 11/1958 | Darrah | 190/108 |
| 3,225,806 | 12/1965 | Pollak et al. | 383/86 X |
| 4,068,786 | 1/1978 | Taniguchi | 150/109 X |
| 4,177,909 | 12/1979 | Haskell | 150/111 X |
| 4,211,091 | 7/1980 | Campbell | 383/110 X |
| 4,211,267 | 11/1980 | Skovgaard | 383/86 X |
| 4,286,639 | 9/1981 | Murphy | 383/61 X |
| 4,424,841 | 1/1984 | Smith | 190/108 X |
| 4,431,041 | 2/1984 | Leiserson | 190/102 X |
| 4,548,375 | 10/1985 | Moss | 383/11 |
| 4,679,242 | 7/1987 | Brockhaus | 383/86 X |
| 4,802,233 | 1/1989 | Skamser | 383/61 X |
| 4,917,160 | 4/1990 | Hart et al. | 383/11 X |
| 4,974,709 | 12/1990 | Furlow et al. | 190/102 |
| 4,988,216 | 1/1991 | Lyman | 383/86 X |
| 5,005,679 | 4/1991 | Hjelle | 190/108 X |
| 5,031,766 | 7/1991 | Cohen | 190/102 X |
| 5,050,713 | 9/1991 | Lee | 190/108 |
| 5,190,376 | 3/1993 | Book | 383/4 |

FOREIGN PATENT DOCUMENTS

| | | | |
|---|---|---|---|
| 78739 | 5/1983 | European Pat. Off. | 383/61 |
| 439420 | 7/1991 | European Pat. Off. | 383/4 |
| 2654637 | 8/1978 | Fed. Rep. of Germany | 383/61 |
| 679562 | 1/1930 | France | 150/106 |
| 2358124 | 2/1978 | France | 190/102 |
| 202688 | 5/1939 | Switzerland | 190/102 |
| 347220 | 4/1931 | United Kingdom | 190/102 |
| 382924 | 11/1932 | United Kingdom | 190/102 |
| 396926 | 8/1933 | United Kingdom | 190/102 |
| 2257028 | 1/1993 | United Kingdom | 190/102 |

OTHER PUBLICATIONS

Brochure from Go/Lightly Manufacturing Company of Rancho Cordova, California 95742 Jan. 1992.

Lands' End Catalogue, Mar. 1993, Item E, Lands' End Inc. 1 Lands' End Lane, Dodgeville, Wis. 53595.

*Primary Examiner*—Sue A. Weaver

*Attorney, Agent, or Firm*—Nikaido, Marmelstein, Murray & Oram

[57] ABSTRACT

A container with a flexible carrying clasp that can be looped around another item to suspend and support the container is provided. The clasp has at its ends a hook portion and a loop portion of a hook and loop fastening system, such that the ends are fastened together to form the loop. The clasp is slidably coupled to a flexible handle attached to the container. The container can be a flexible, collapsible bag. Where the bag is used for carrying food or beverage, it is thermally insulated. The bag may be sealed by a zipper or by a hook and loop fastening system.

15 Claims, 3 Drawing Sheets

BAG HANDLE WITH SUPPORT LOOP

FIELD OF THE INVENTION

This invention relates to a container system for carrying articles.

BACKGROUND OF THE INVENTION

It is common for individuals to carry articles in a container having a handle. It is also known to provide such containers with thermal insulation to maintain the internal temperature when foods and beverages are contained therein.

Thermally insulated bags having two handles, one on each side of the bag opening, are known. The bag is sealed to maintain its internal temperature, and the two handles are grasped together so that the bag may be carried by hand. Another type of thermally insulated bag has a single handle with an end affixed to the bag on either side of its opening. The bag is sealed and carried by the single handle. Go/Lightly Manufacturing Company of Rancho Cordova, Calif. manufactures both types of bags. For example, the first type, the CHILL-N-GO bag, is manufactured by Go/Lightly for sale by Williams-Sonoma of California and others.

Such bags, however, may be inconvenient in certain situations where the user's hands are otherwise occupied. For example, the user may be carrying packages, a briefcase, a purse or an umbrella. The user may be pushing a stroller or holding a toddler's hand. He/she may be cross-country skiing, with a ski pole in each hand. Alternatively, a hiker may simply wish to keep both hands free.

SUMMARY OF THE INVENTION

The present invention provides a container system comprising a container and a clasp to enable it to be connected to another article, such as a briefcase, backpack or purse. It is particularly suited to thermally insulated containers for carrying foods and beverages.

The present invention provides, in one aspect, a container system including a container and a clasp for engaging the container to another article so that the container is supported thereby. The clasp may be flexible and have engagement means that loop around at least a portion of the other article. The container may have a handle that is coupled to the clasp.

The clasp may have first and second ends for fastening together and a middle section disposed therebetween, such that the clasp takes the shape of a loop when the two ends are fastened. The first end of the clasp may have a hook portion of a hook and loop fastening system and the second end of the clasp may have a loop portion of a hook and loop fastening system.

The middle section may include a panel and a crosspiece attached to each other such that the panel and the crosspiece define an aperture through which the handle is disposed. The handle may be slidably disposed through the aperture, and may be flexible.

The container may be flexible, and may be a bag. The bag may have portions of a hook and loop fastening system disposed on its interior surfaces to seal it. It may have an exterior surface and a top portion with an interior surface, each of these surfaces having a corresponding portion of a hook and loop fastening system disposed thereon, such that the top portion of the bag can be folded over the exterior surface so that the hook or loop portion on its interior surface is engaged by the corresponding hook or loop portion on the exterior surface. The bag may have a zipper for sealing it.

In a second aspect, the present invention provides a container system including a flexible bag, a flexible handle attached to the bag and a flexible clasp coupled to the handle and having first and second ends, each end having a portion of a hook and loop fastening system, such that the clasp may be looped around another article and the hook and loop portions engaged so that the bag is supported by the other article.

The bag may have (i) a zipper for sealing it and (ii) an exterior surface and a top portion with an interior surface, each of these surfaces having a corresponding portion of a hook and loop fastening system disposed thereon, such that the top portion of the bag can be folded over the exterior surface so that the hook or loop portion on its interior top surface is engaged by the corresponding hook or loop portions of a hook and loop fastening system disposed on its interior surfaces for sealing it.

The container system of the first or second aspects of the invention may include a thermally insulated container.

In a third aspect, the present invention provides a clasp for connecting a container to another article so that the container is supported thereby. The clasp includes an elongate member having (i) means for coupling to the container, (ii) first and second ends, (iii) a middle section disposed between the two ends, at least a portion of the middle section is flexible and (iv) first and second means attached to the first and second ends for engaging each other, such that the elongate member may be looped around at least a portion of the other article and the ends engaged to support the container. The first end may have a hook portion of a hook and loop fastening system and the second end may have a loop portion of a hook and loop fastening system. The middle section may include a panel and a crosspiece attached to each other such that the panel and the crosspiece define an aperture through which a handle of the container can be disposed.

BRIEF DESCRIPTION OF THE DRAWINGS

For a better understanding of the present invention and to show more clearly how it may be carried into effect, reference is made by way of example to the accompanying drawings, which show a preferred embodiment of the invention, in which.

DETAILED DESCRIPTION OF THE PREFERRED EMBODIMENTS

Figure 1:
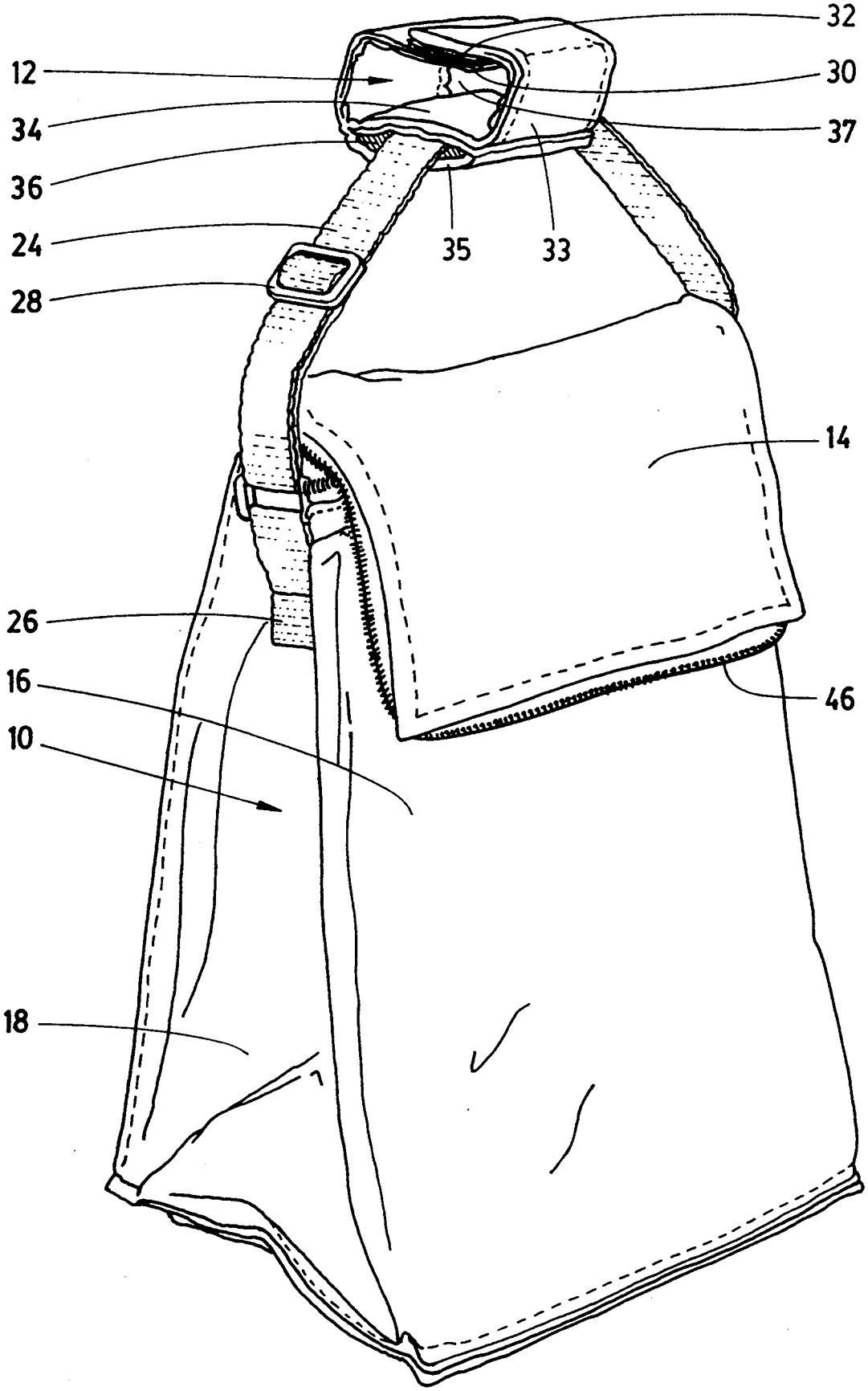
FIG. 1 is a perspective view from the front and a side of a bag with a carrying clasp.

FIG. 1 shows a bag 10 with a carrying clasp 12. The bag has a substantially rectangular, durable, flexible, collapsible casing with a top exterior surface 14, a front exterior surface 16, two side exterior surfaces 18, a bottom exterior surface 20 and a back exterior surface 22. The bottom exterior surface and the back exterior surface are shown in cross-section in FIG. 2. The exterior surfaces may be of polyvinyl chloride, nylon or other suitable material.

Referring again to FIG. 1, a flexible handle 24 with two ends 26 is provided, each end 26 being attached to a respective side exterior surface. The handle is conveniently made of webbed material and has slider means 28 for adjustment of its length, if desired.

Transverse to the handle is the flexible clasp, which has a first end 30 a second end 32 and a middle section 33 intermediate between the two ends. The middle section has a crosspiece 34 and a panel 35 that are attached to each other such that they define a first aperture 36 through which the handle is slidably disposed. The aperture 36 is sufficiently large to allow the passage of the slider means. The first end of the clasp is provided with a hook portion of a hook and loop fastening system; the second end is provided with a loop portion of a hook and loop fastening system. The ends 30 and 32 may be engaged so that the clasp is arranged in a loop defining a second aperture 37. The hook and loop fastening system may be the VELCRO brand.

Figure 2:
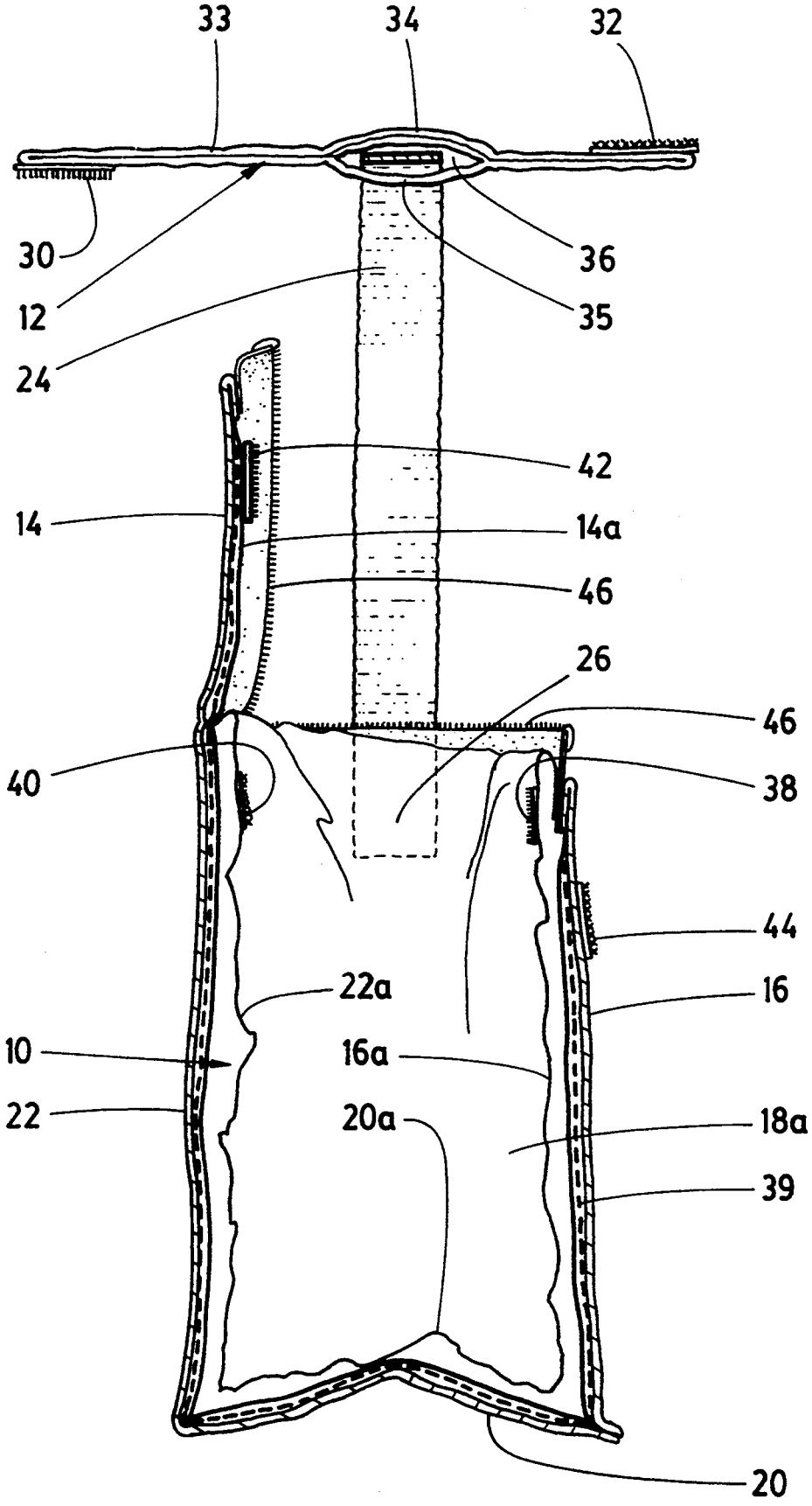
FIG. 2 is a cross-sectional side elevation of the bag with carrying clasp of FIG. 1.

FIG. 2 shows the bag and the clasp in cross-section. The bag has interior surfaces 14*a*, 16*a*, 18*a*, 20*a* and 22*a* made of durable, flexible, waterproof material. Where foods, beverages and other materials requiring temperature maintenance are to be contained, insulating material 39 is inserted between the exterior and interior surfaces. This material may be closed cell foam insulation.

A hook portion 38 of a hook and loop fastening system and a loop portion 40 of a hook and loop fastening system are provided respectively on interior surfaces 16*a* and 22*a* such that they can be engaged to seal the bag. A hook portion 42 and a loop portion 44 of a hook and loop fastening system are also provided respectively on interior surface 14*a* and on front exterior surface 16, such that when the bag is sealed with the engagement of hook and loop portions 38 and 40, the top of the casing can be folded over the front exterior surface 16 and hook and loop portions 42 and 44 engaged, as depicted in FIG. 1. This provides a better thermal seal than the engagement of hook and loop portions 38 and 40 alone. The positions of the hook portion and the loop portion of the fastening system might be interchanged in different embodiments of the invention. The portions 38 and 40 are not present in another preferred embodiment of the invention.

Figure 3:
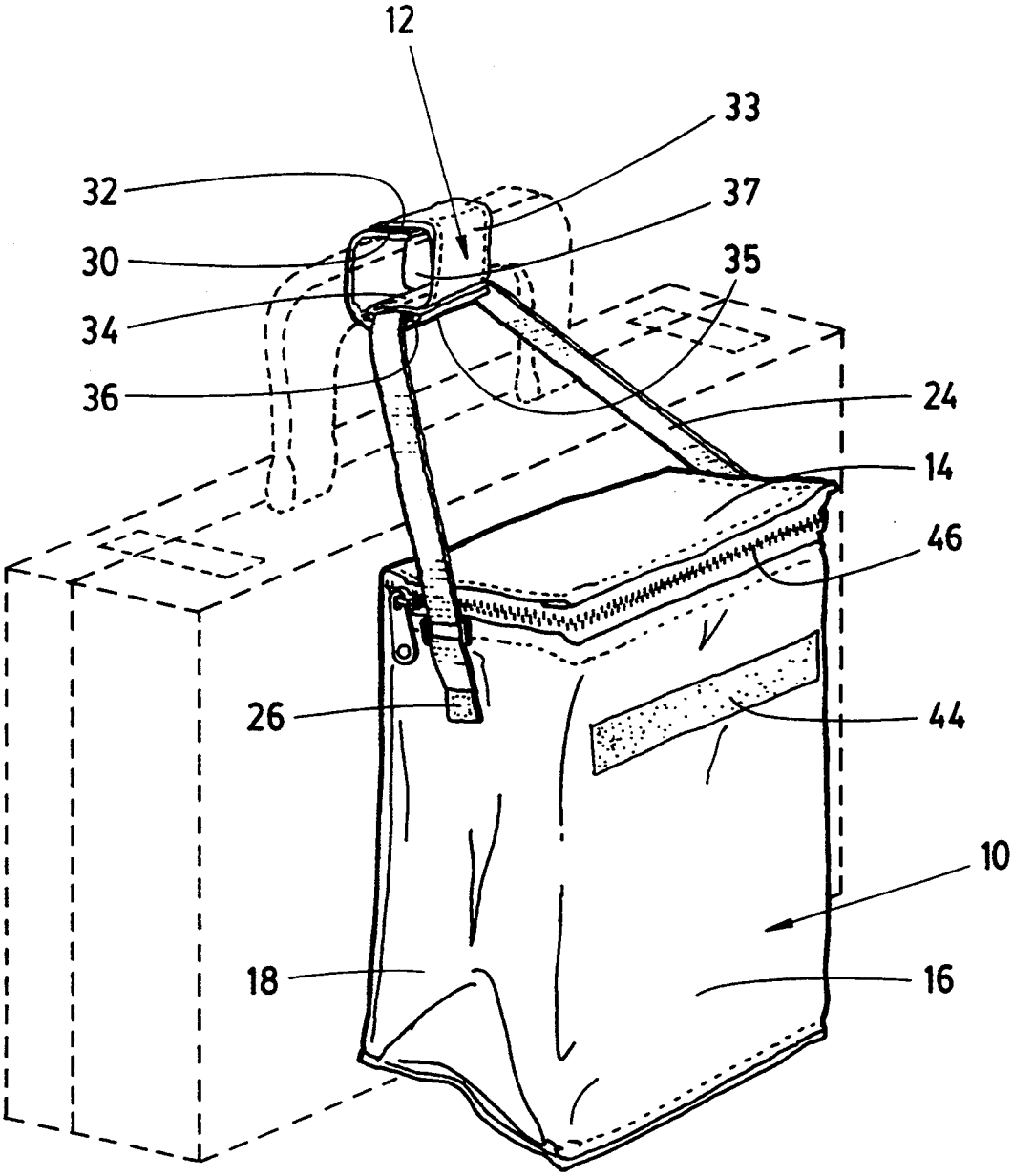
FIG. 3 is a perspective view from the front and a side of the bag with carrying clasp of FIG. 1 in use with a briefcase.

As shown in FIG. 3, the bag may alternatively be sealed by a zipper 46 that is provided where the top surface meets the front and side surfaces. This is convenient when the contents of the bag prevent the folding over of the top of the bag and the engagement of hook and loop portions 42 and 44.

In operation, the thermally insulated bag and carrying clasp of the preferred embodiment can be easily transported in either of two modes. It can be carried in the conventional manner by hand using the handle.

In addition, the clasp can be used to secure the bag to another convenient item, thus leaving the user's hands free to perform other tasks. Such an item may be a briefcase, as shown in FIG. 3, a strap on a backpack or a purse, the cross-bar of a stroller, etc. Accordingly, the length of the clasp must be sufficient to loop around a variety of items. In addition, the sizes of the hook and loop portions at the ends 30 and 32 of the clasp must be sufficient for them to remain securely engaged when the full casing is suspended and supported in this second mode of transport. The length of the handle relative to the item on which the bag is mounted may be conveniently adjusted using the slider means.

The preferred embodiment of the present invention presents a number of advantages over commonly manufactured bags. It can be carried in different modes, depending on the demands of or upon the user in different situations. It can be easily and rapidly switched from one mode to another using a hook and loop fastening system, without requiring other, more cumbersome means. The bag can be sealed with a hook and loop fastening system or with a zipper, as circumstances require. The flexibility and collapsibility of the bag, handle and clasp contribute to ease and convenience of use.

It will be understood that this description is made with reference to the preferred embodiment of the invention. However, it is possible to make other embodiments that employ the principles of the invention and that fall within its spirit and scope as defined by the following claims.

What is claimed is:

1. A container system comprising:

a container having a handle; and a flexible clasp for engaging the container to another article so that the container is supported thereby, the clasp being coupled to the handle and having a) first and second ends for fastening together, wherein the clasp takes a shape of a loop when the two ends are fastened, b) a middle section disposed between the first and second ends, the middle section having a panel and a crosspiece that are attached to each other such that the panel and the crosspiece define an aperture through which the handle is disposed, and c) engagement means that loop around at least a portion of the other article, the engagement means including a hook and loop fastening system having a hook portion on the first end of the clasp and a loop portion on the second end of the clasp.

2. The container system of claim 1, wherein the handle is slidably disposed through the aperture.

3. The container system of claim 1, wherein the handle is flexible.

4. The container system of claim 2, wherein the container is flexible.

5. The container system of claim 4, wherein the container is a bag.

6. The container system of claim 5, wherein the bag comprises a zipper for sealing the bag.

7. The container system of claim 6, wherein the bag has an exterior surface having a portion of a hook and loop fastening system disposed thereon and a top portion having an interior surface with a corresponding portion of a hook and loop fastening system disposed thereon, such that the top portion of the bag can be folded over the exterior surface so that the hook or loop portion on its interior surface is engaged by the corresponding hook or loop portion on the exterior surface.

8. The container system of claim 7, wherein the bag has portions of a hook and loop fastening system disposed on its interior surfaces for sealing the bag.

9. The container system of claim 5, wherein the container is thermally insulated.

10. The container system of claim 1, wherein the container is thermally insulated.

11. A container system, comprising:

a flexible bag having a zipper for sealing the bag;

a flexible handle attached to the bag; and a flexible clasp coupled to the handle and having first and second ends and a middle section disposed therebetween, the first end including a hook portion of a hook and loop fastening system and the second end including a loop portion of a hook and loop fastening system;

wherein the clasp is looped around another article and the hook and loop portions on the ends are engaged so that the bag is supported thereby; and wherein the bag includes an exterior surface having a portion of a hook and loop fastening system disposed thereon and a top portion having an interior surface with a corresponding portion of a hook and loop fastening system disposed thereon, such that the top portion of the bag can be folded over the exterior surface so that the hook or loop portion on its interior surface is engaged by the corresponding hook or loop portion on the exterior surface.

12. The container system of claim 11, the bag further comprising portions of a hook and loop fastening system disposed on its interior surfaces for sealing the bag.

13. The container system of claim 12, wherein the container is thermally insulated.

14. The container system of claim 11, wherein the container is thermally insulated.

15. A clasp for connecting a container having a handle to another article so that the container is supported thereby, comprising:

an elongate member having coupling means for coupling to the container, first and second ends, a middle section disposed between the first and second ends, the middle section having a panel and a crosspiece that are attached to each other such that the panel and the crosspiece define an aperture through which the handle of the container is disposed, at least a portion of the middle section being flexible, and first and second engagement means attached to the first and second ends for engaging each other, the first engagement means including a hook portion of a hook and loop fastening system and the second engagement means including a loop portion of the hook and loop fastening system;

wherein the elongate member is looped around at least a portion of the other article and the ends are engaged to support the container.

* * * * *